US009760050B2

(12) United States Patent
Tanaka et al.

(10) Patent No.: US 9,760,050 B2
(45) Date of Patent: Sep. 12, 2017

(54) SHEET CONVEYING DEVICE AND IMAGE FORMING APPARATUS

(71) Applicant: FUJI XEROX CO., LTD., Tokyo (JP)

(72) Inventors: Toshitaka Tanaka, Yokohama (JP); Kiyoshi Watanabe, Yokohama (JP); Junji Hagihara, Yokohama (JP); Tatsuya Yamashita, Yokohama (JP); Yuta Chino, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/849,812

(22) Filed: Sep. 10, 2015

(65) Prior Publication Data

US 2016/0282784 A1 Sep. 29, 2016

(30) Foreign Application Priority Data

Mar. 27, 2015 (JP) ..... 2015-066311
Mar. 27, 2015 (JP) ..... 2015-067138

(51) Int. Cl.
*B65H 9/16* (2006.01)
*G03G 15/00* (2006.01)
*B65H 9/00* (2006.01)

(52) U.S. Cl.
CPC ..... *G03G 15/6529* (2013.01); *B65H 9/004* (2013.01); *B65H 9/16* (2013.01); *B65H 9/166* (2013.01); *G03G 2215/00679* (2013.01)

(58) Field of Classification Search
CPC ..... B65H 9/16; B65H 9/166
See application file for complete search history.

(56) References Cited

U.S. PATENT DOCUMENTS 5,657,983 A 8/1997 Fisk
7,658,379 B2 2/2010 Yasumoto
2008/0174064 A1 7/2008 Bandholz et al.

FOREIGN PATENT DOCUMENTS

JP 2000351479 A * 12/2000
JP 2003118892 A * 4/2003
JP 2014-021566 A 2/2014
WO 2011151984 A1 12/2011

OTHER PUBLICATIONS

Office Action dated Feb. 17, 2016 issued by the Australian Patent Office in counterpart Australian Patent Application No. 2015230709.

* cited by examiner

*Primary Examiner* — Luis A Gonzalez
(74) *Attorney, Agent, or Firm* — Sughrue Mion, PLLC

(57) ABSTRACT

A sheet conveying device includes: a conveyance path along which a sheet is conveyed; a plurality of butting target members that are arranged beside and alongside the conveyance path and against which a side edge of a sheet being conveyed along the conveyance path is caused to butt; and a butting device that causes the side edge of the sheet to butt against the butting target members by moving, toward the butting target members, the sheet being conveyed along the conveyance path using a plurality of sheet conveying structures that are deviated from each other in a sheet conveying direction, and two or more of the butting target members are located downstream of a sheet conveying structure that is located second in the upstream direction from a most downstream one among the plurality of sheet conveying structures.

7 Claims, 10 Drawing Sheets

SHEET CONVEYING DEVICE AND IMAGE FORMING APPARATUS

CROSS-REFERENCE TO RELATED APPLICATIONS

This application is based on and claims priority under 35 USC 119 from Japanese Patent Application No. 2015-066311 filed on Mar. 27, 2015 and Japanese Patent Application No. 2015-067138 filed on Mar. 27, 2015.

BACKGROUND

Technical Field

The present invention relates to a sheet conveying device and an image forming apparatus.

SUMMARY

According to an aspect of the invention, there is provided a sheet conveying device comprising a conveyance path along which a sheet is conveyed; plural butting target members that are arranged beside and alongside the conveyance path and against which a side edge of a sheet being conveyed along the conveyance path is caused to butt; and a butting device that causes the side edge of the sheet to butt against the butting target members by moving, toward the butting target members, the sheet being conveyed along the conveyance path using plural sheet conveying structures that are deviated from each other in a sheet conveying direction, wherein two or more of the butting target members are located downstream of a sheet conveying structure that is located second in the upstream direction from a most downstream one among the plural sheet conveying structures.

BRIEF DESCRIPTION OF THE DRAWINGS

Exemplary embodiments of the present invention will be described in detail based on the following figures, wherein.

DESCRIPTION OF SYMBOLS

10 . . . Image forming unit; 20 . . . Intermediate transfer belt; 30 . . . Secondary transfer device; 44 . . . First conveying rolls; 45 . . . Second conveying rolls; 78 . . . Butting target member; 100 . . . Image forming apparatus; 451 . . . Downstream conveying rolls; 452 . . . Intermediate conveying rolls; 453 . . . Upstream conveying rolls; 780B . . . First slant surface; D1 . . . Installation interval; P . . . Sheet; PS . . . Side edge; R1 . . . First sheet conveyance path; SR . . . One side.

DETAILED DESCRIPTION

An exemplary embodiment of the present invention will be hereinafter described in detail with reference to the drawings.

Figure 1:
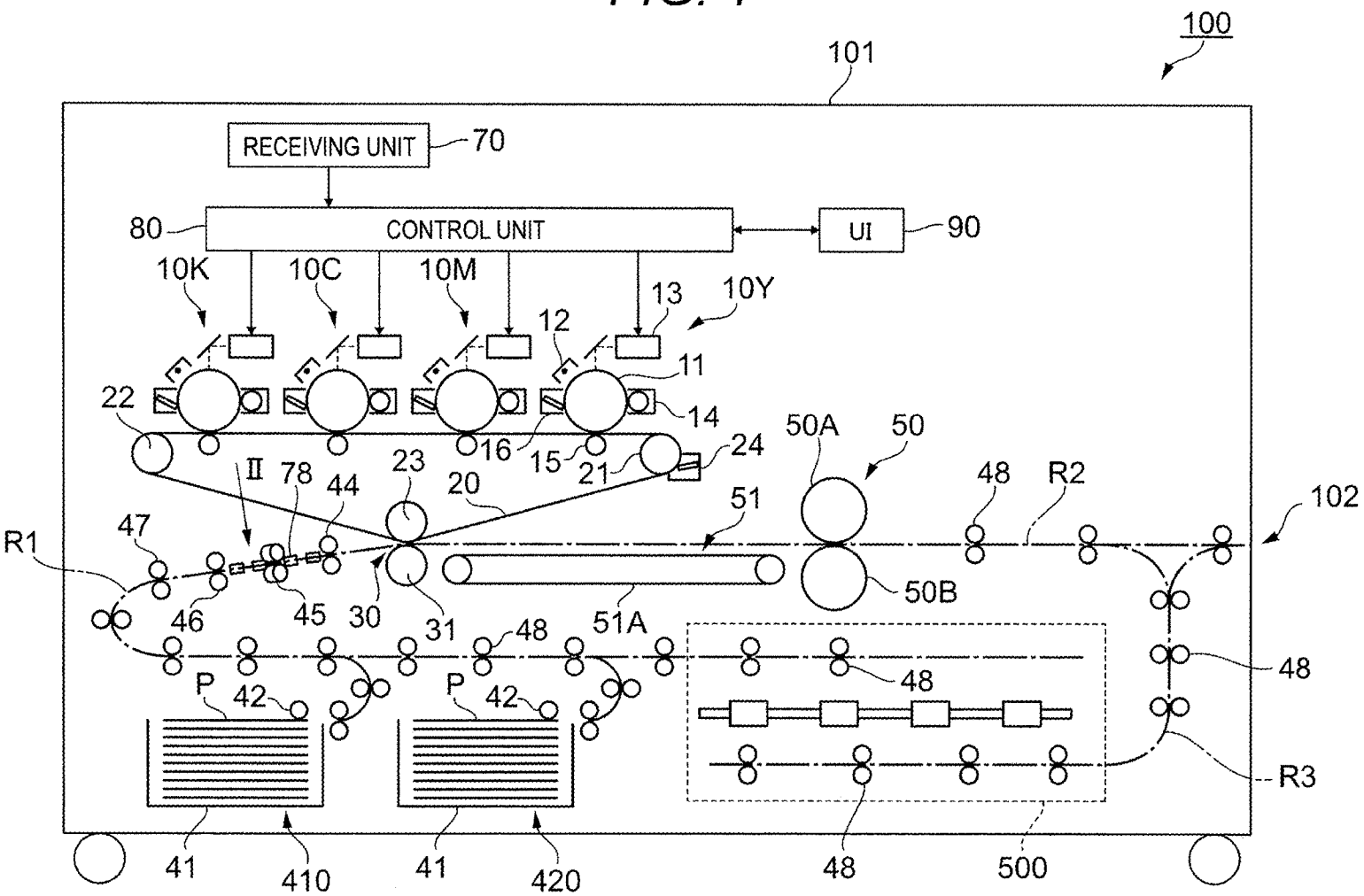
FIG. 1 is a front view of an image forming apparatus according to an exemplary embodiment.

FIG. 1 is a front view of an image forming apparatus 100 according to the exemplary embodiment. The image forming apparatus 100 is equipped with plural image forming units 10 (10Y, 10M, 10C, and 10K) for forming toner images of respective color components by an electrophotographic method. The image forming apparatus 100 is also equipped with the following units, devices, etc.

A control unit 80 is composed of a CPU (central processing unit), a ROM (read-only memory), etc., and controls operations of individual constituent units, devices, etc. of the image forming apparatus 100.

A user interface unit (UI) 90, which is a display panel, outputs an instruction received from a user to the control unit 80 and displays, to the user, information received from the control unit 80.

An intermediate transfer belt 20 is a belt to which toner images of the color components formed by the image forming units 10, respectively, are transferred sequentially (primary transfer). A secondary transfer device 30 transfers the toner images together from the intermediate transfer belt 20 to a sheet P (secondary transfer). The image forming units 10, the intermediate transfer belt 20, and the secondary transfer device 30 can be regarded as an image forming unit that forms an image on a sheet P.

A sheet P goes along a first sheet conveyance path R1 as it is conveyed to the secondary transfer device 30. After passing the secondary transfer device 30, the sheet goes along a second sheet conveyance path R2. A third sheet conveyance path R3 branches off the second sheet conveyance path R2 and extends to under the first sheet conveyance path R1.

A flip mechanism 500 flips a sheet P as it conveys the sheet from the third sheet conveyance path R3 to the first sheet conveyance path R1. An opening 102 is formed through a body 101 of the image forming apparatus 100.

A sheet P that has been conveyed by the second sheet conveyance path R2 is ejected to outside the body 101 through the opening 102 and placed on a sheets stacking unit (not shown). A processing device (not shown) may be disposed adjacent to the body 101 to perform such processing as formation of holes on sheets P that are ejected through the opening 102.

A first sheet supply device 410 and a second sheet supply device 420 supply a sheet P to the first sheet conveyance path R1. The first sheet supply device 410 and the second sheet supply device 420 are configured in the same manner, and each of them is equipped with a sheets housing unit 41 which houses sheets P and a pickup roll 42 which picks up a sheet P from the sheets housing unit 41 and sends it out.

First conveying rolls (registration rolls) 44 for conveying a sheet P from the first sheet conveyance path R1 to the secondary transfer device 30 are disposed upstream of the secondary transfer device 30. The first conveying rolls 44 are a pair of roll-shaped members. The first conveying rolls 44 stop a sheet P temporarily and then send it out to the secondary transfer device 30 with predetermined timing.

Butting target members 78 against which one side edge of a sheet P being conveyed along the first sheet conveyance path R1 is caused to butt are disposed upstream of the first conveying rolls 44. The butting target members 78 are arranged on one side of the first sheet conveyance path R1.

Second conveying rolls (alignment rolls) 45 are disposed on the viewer's side of the butting target members 78 in FIG. 1 (in the depth direction of the image forming apparatus 100). The second conveying rolls 45, which function as a butting device, move a sheet P toward the butting target members 78 and cause its one side edge to butt against the butting target members 78 while conveying the sheet P downstream. The second conveying rolls 45 are plural pairs of roll-shaped members.

Third conveying rolls (pre-alignment rolls) 46 are disposed upstream of the second conveying rolls 45. The third conveying rolls 46 rotate (incline) a sheet P while conveying it downstream. Fourth conveying rolls 47 are disposed upstream of the third conveying rolls 46. The fourth conveying rolls 47 convey a sheet P toward the third conveying rolls 46. The third conveying rolls 46 are plural pairs of roll-shaped members, and so are the fourth conveying rolls 47.

A unit including the first conveying rolls 44 to the fourth conveying rolls 47 has a function of conveying a sheet P and can be regarded as a sheet conveying device.

In the exemplary embodiment, in addition to the above conveying rolls, plural pairs of conveying rolls 48 are disposed along the first sheet conveyance path R1, the second sheet conveyance path R2, and the third sheet conveyance path R3 to convey a sheet P located there.

A fusing device 50 for fusing, on a sheet P, an image that has been transferred to it secondarily by the secondary transfer device 30 is disposed on the second sheet conveyance path R2.

A conveying device 51 for conveying a sheet P that has passed the secondary transfer device 30 to the fusing device 50 is disposed between the secondary transfer device 30 and the fusing device 50. Having a circulating belt 51A, the conveying device 51 conveys a sheet P that is placed on the belt 51A.

The fusing device 50 is equipped with a heating roll 50A which is heated by a built-in heater (not shown) and a pressing roll 50B which is pressed against the heating roll 50A. In the fusing device 50, a sheet P is pressed and heated as it passes between the heating roll 50A and the pressing roll 50B. An image on the sheet P is thereby fused on the sheet P.

Each image forming unit 10 is equipped with a rotatable photoreceptor drum 11. A charging device 12 for charging the photoreceptor drum 11, an exposing device 13 for writing an electrostatic latent image onto the photoreceptor drum 11 by exposing it to light, and a developing device 14 for visualizing the electrostatic latent image on the photoreceptor drum 11 with toner are arranged around the photoreceptor drum 11. A primary transfer device 15 for transferring a toner image of the corresponding color formed on the photoreceptor drum 11 to the intermediate transfer belt 20 and a drum cleaning device 16 for removing residual toner from the photoreceptor drum 11 are also arranged around the photoreceptor drum 11.

The intermediate transfer belt 20 are wound on three roll members 21-23 and is thus rotatable. Among the three roll members 21-23, the roll member 22 drives the intermediate transfer belt 20. The roll member 23 is opposed to a secondary transfer roll 31 with the intermediate transfer belt 20 sandwiched between them, and the secondary transfer roll 31 and the roll member 23 constitute the secondary transfer device 30. A belt cleaning device 24 for removing residual toner from the intermediate transfer belt 20 is disposed at such a position as to be opposed to the roll member 21 with the intermediate transfer belt 20 sandwiched between them.

The image forming apparatus 100 according to the exemplary embodiment can form images on both surfaces of a sheet P that is supplied from, for example, the first sheet supply device 410. More specifically, in the image forming apparatus 100, a sheet P that has passed the fusing device 50 is flipped by the flip mechanism 500 and the flipped sheet P is returned to the secondary transfer device 30. Another image is transferred to the other surface of the sheet P by the secondary transfer device 30. The sheet P again passes the fusing device 50 and the transferred image is fused on the sheet P. In this manner, the images are formed on both surfaces of the sheet P.

In the flip mechanism 500, first, a sheet P is moved in a direction that is perpendicular to the extending direction of the third sheet conveyance path R3 from the third sheet conveyance path R3 to, for example, the front side of the image forming apparatus 100. This is done by dedicated conveying rolls (not shown). During that course, the part, installed in the flip mechanism 500, of the pairs of conveying rolls 48 arranged along the third sheet conveyance path R3 are separated from the sheet P.

The sheet P that has been moved in the perpendicular direction is then moved upward being guided by a guide member (not shown) having an approximately C-shaped cross section, for example. The sheet P is moved upward further by conveying rolls (not shown) provided for this purpose.

The sheet P is then moved to the first sheet conveyance path R1 from its side. During that course, the part, installed in the flip mechanism 500, of the pairs of conveying rolls 48 arranged along the first sheet conveyance path R1 are separated from the sheet P.

Subsequently, the pairs of conveying rolls 48 nip the sheet P and are rotated, whereby the flipped sheet P is moved to the secondary transfer device 30.

Figure 2:
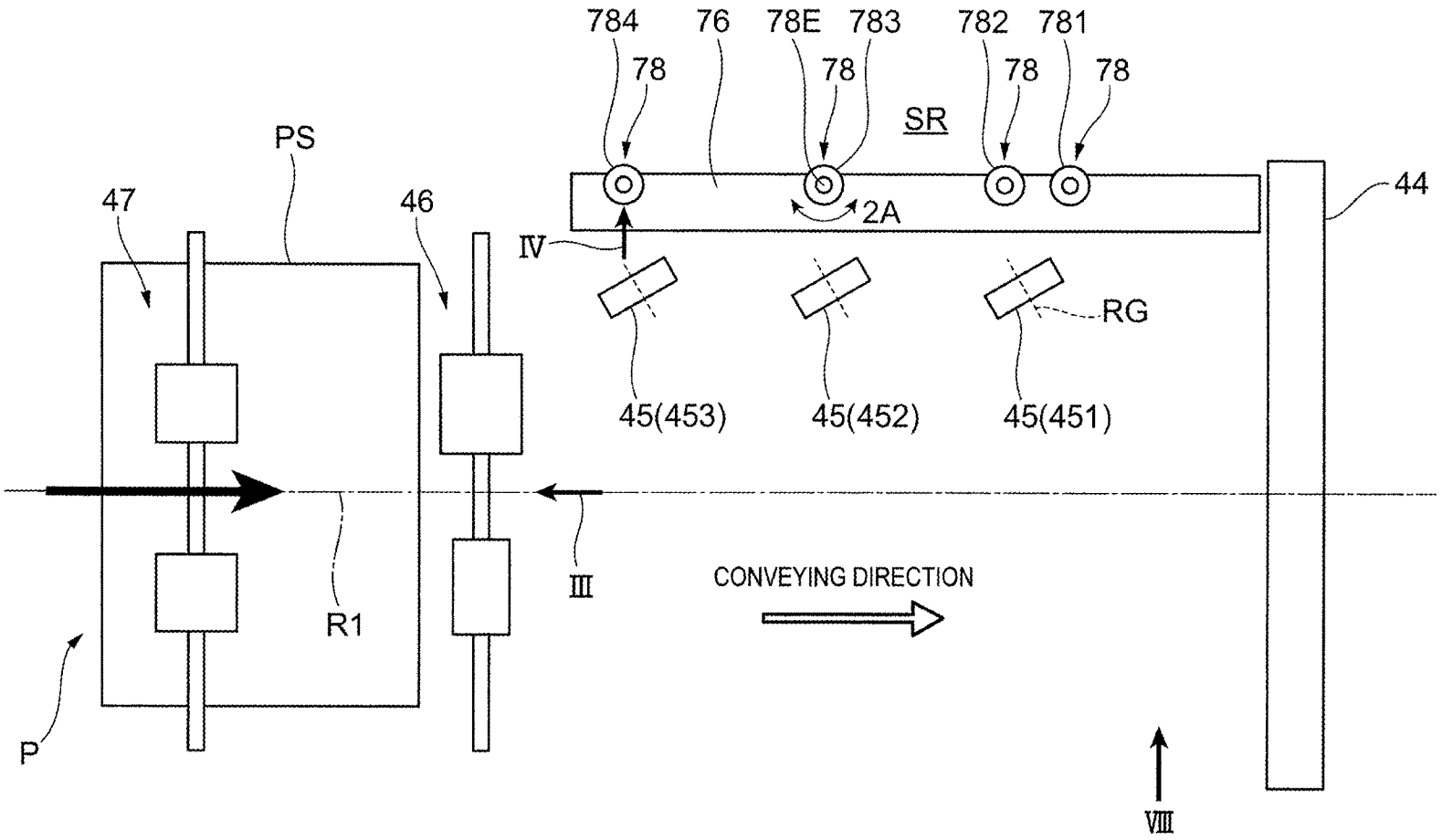
FIG. 2 is a view of a first sheet conveyance path as viewed from the direction indicated by arrow II in FIG. 1.

FIG. 2 is a view of the first sheet conveyance path R1 as viewed from the direction indicated by arrow II in FIG. 1. As shown in FIG. 2 and described above, in the exemplary embodiment, the first conveying rolls (registration rolls) 44 are provided which convey a sheet P along the first sheet conveyance path R1 to the secondary transfer device 30 (see FIG. 1).

The plural butting target members 78 against which one side edge PS of a sheet P on the first sheet conveyance path R1 is caused to butt are arranged on one side (rear side) SR of (i.e., alongside) the first sheet conveyance path R1. Each butting target member 78 is rotatable about a rotation shaft 78E in the circumferential direction (indicated by arrow 2A).

In the exemplary embodiment, a sheet P is moved downstream while butting against the butting target members 78 (described later in detail). During that course, the sheet P is moved more smoothly because the butting target members 78 are rotatable. The butting target members 78 are supported by a support member 76 which is disposed under them.

The plural (in the exemplary embodiment, three) pairs of second conveying rolls (alignment rolls) 45 which move a sheet P toward the butting target members 78 and cause its one side edge PS to butt against the butting target members 78 while conveying the sheet P downstream are disposed at such positions as to be opposed to the butting target members 78. Each pair of second conveying roll 45 are inclined; more specifically, their rotation axes RG are inclined from the direction that is perpendicular to the extending direction of the first sheet conveyance path R1.

Having a function of conveying a sheet P, each of the three pairs of second conveying rolls 45 can be regarded as a sheet conveying structure. The three pairs of second conveying rolls 45 are deviated from each other in the sheet P conveying direction (left-right direction in FIG. 2). As a result, the three pairs of second conveying rolls 45 are located at a most downstream position, an intermediate position (located second from the most downstream position in the upstream direction), and a most upstream position, respectively.

In this specification, the most downstream second conveying rolls 45, the intermediate second conveying rolls 45 (located second in the upstream direction), and the most upstream second conveying rolls 45 will be referred to as downstream conveying rolls 451, intermediate conveying rolls 452, and upstream conveying rolls 453, respectively.

The relationships between the butting target members 78, the downstream conveying rolls 451, the intermediate conveying rolls 452, and the upstream conveying rolls 453 will be described below. In the exemplary embodiment, two butting target members 78 are located at such positions as to be opposed to the downstream conveying rolls 451. In this specification, of these two butting target members 78, the downstream one and the upstream one will be referred to as a first butting target member 781 and a second butting target member 782, respectively.

One butting target member 78 (hereinafter referred to as a third butting target member 783) is located at such a position as to be opposed to the intermediate conveying rolls 452, and one butting target member 78 (hereinafter referred to as a fourth butting target member 784) is located at such a position as to be opposed to the upstream conveying rolls 453. In the exemplary embodiment, the two butting target members 78, that is, the first butting target member 781 and the second butting target member 782, are located downstream of the intermediate conveying rolls 452 (located second in the upstream direction).

Figure 3:
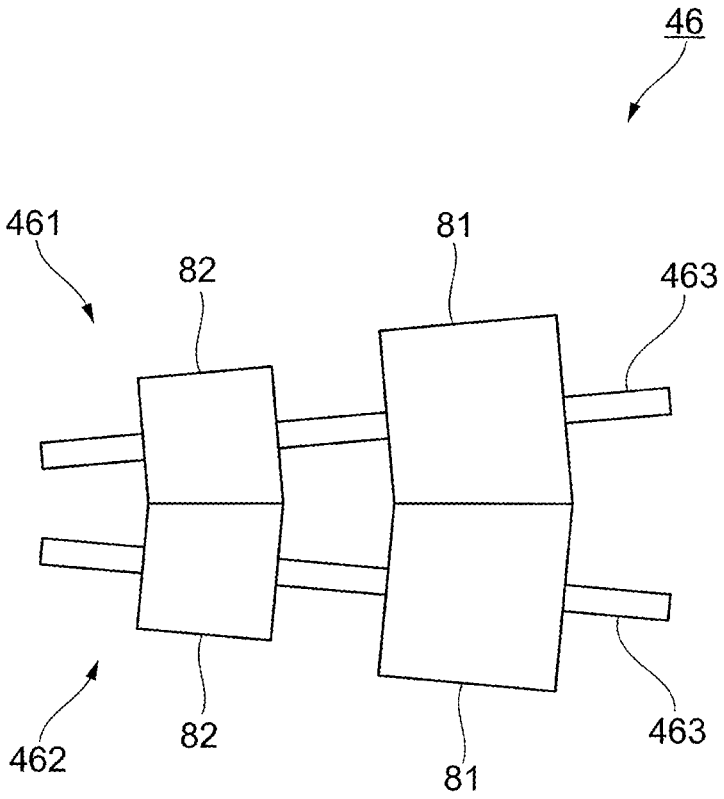
FIG. 3 is a view of third conveying rolls as viewed from the direction indicated by arrow III in FIG. 2.

As shown in FIG. 3 which is a view of the third conveying rolls 46 as viewed from the direction indicated by arrow III in FIG. 2, the third conveying rolls (pre-alignment rolls) 46 are two pairs of roll-shaped members 461 and 462. Each of the two pairs of roll-shaped members 461 and 462 consists of two rolls 81 and 82 which are attached to a rotary shaft 463.

In the exemplary embodiment, the roll member 81 is larger in diameter and hence higher in circumferential speed than the roll member 82. As a result, a sheet P is rotated as it passes between the third conveying rolls 46 (described later in detail).

Figure 4:
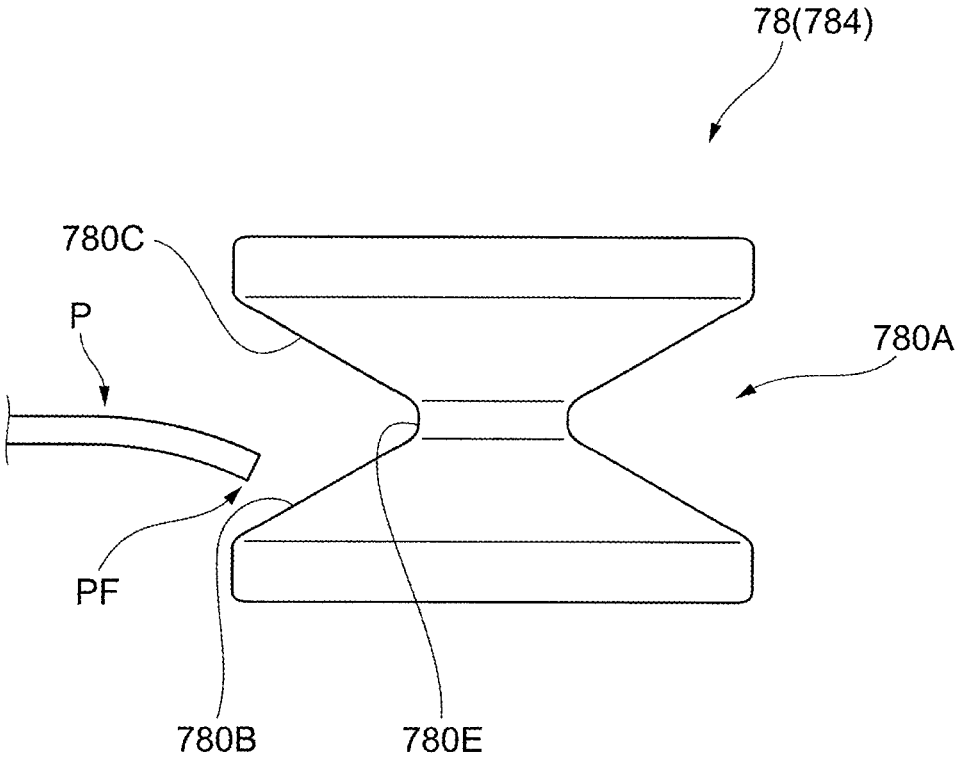
FIG. 4 is a view of one butting target member as viewed from the direction indicated by arrow IV in FIG. 2.

FIG. 4 is a view of one butting target member 78 (fourth butting target member 784) as viewed from the direction indicated by arrow IV in FIG. 2. As shown in FIG. 4, the butting target member 78 has a recessed circumferential surface 780A that is V-shaped in cross section.

Thus, the recessed circumferential surface 780A of the butting target member 78 has a first slant surface 780B which rises toward a bottom 780E of the recessed circumferential surface 780A and a second slant surface 780 C which falls toward the bottom 780E. As shown in FIG. 4, the head PF of a sheet P may go low while it is conveyed. In that event, the head PF hits the first slant surface 780B and is lifted up by it.

Figure 5:
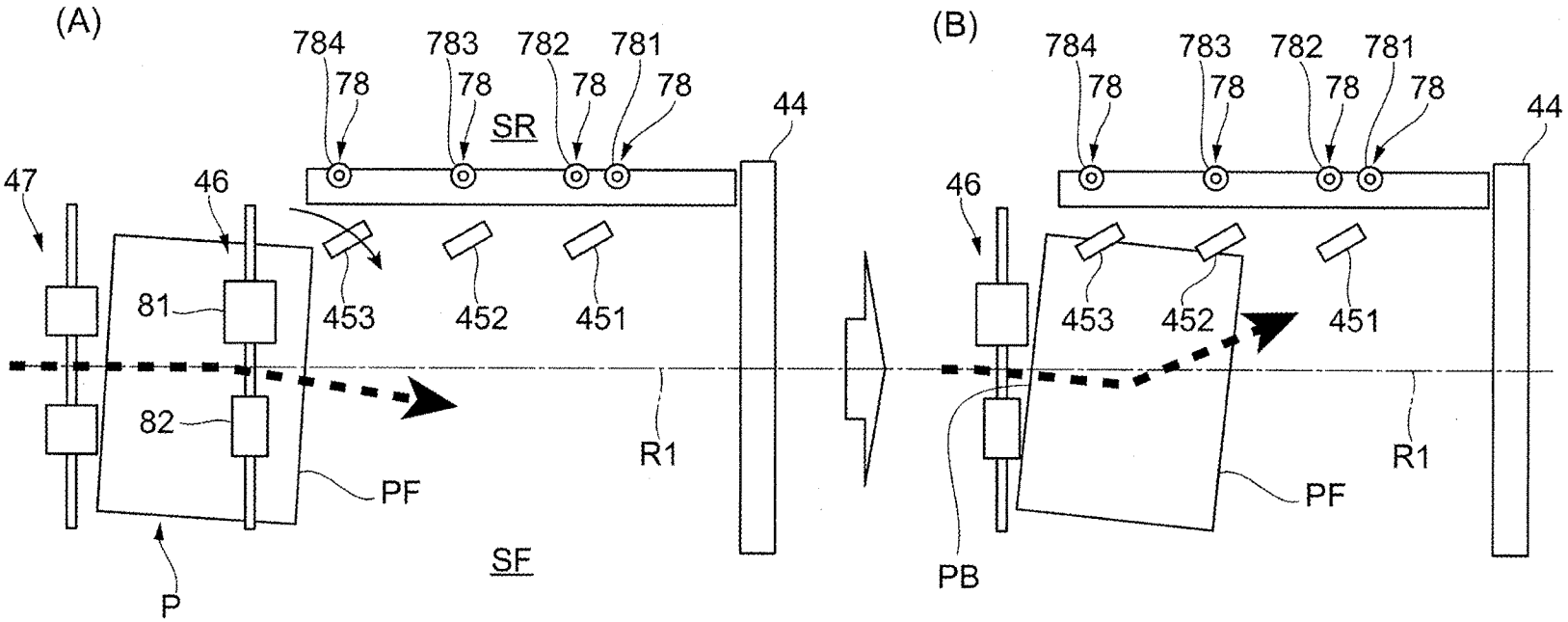
FIG. 5 illustrates movements of a sheet.
Figure 6:
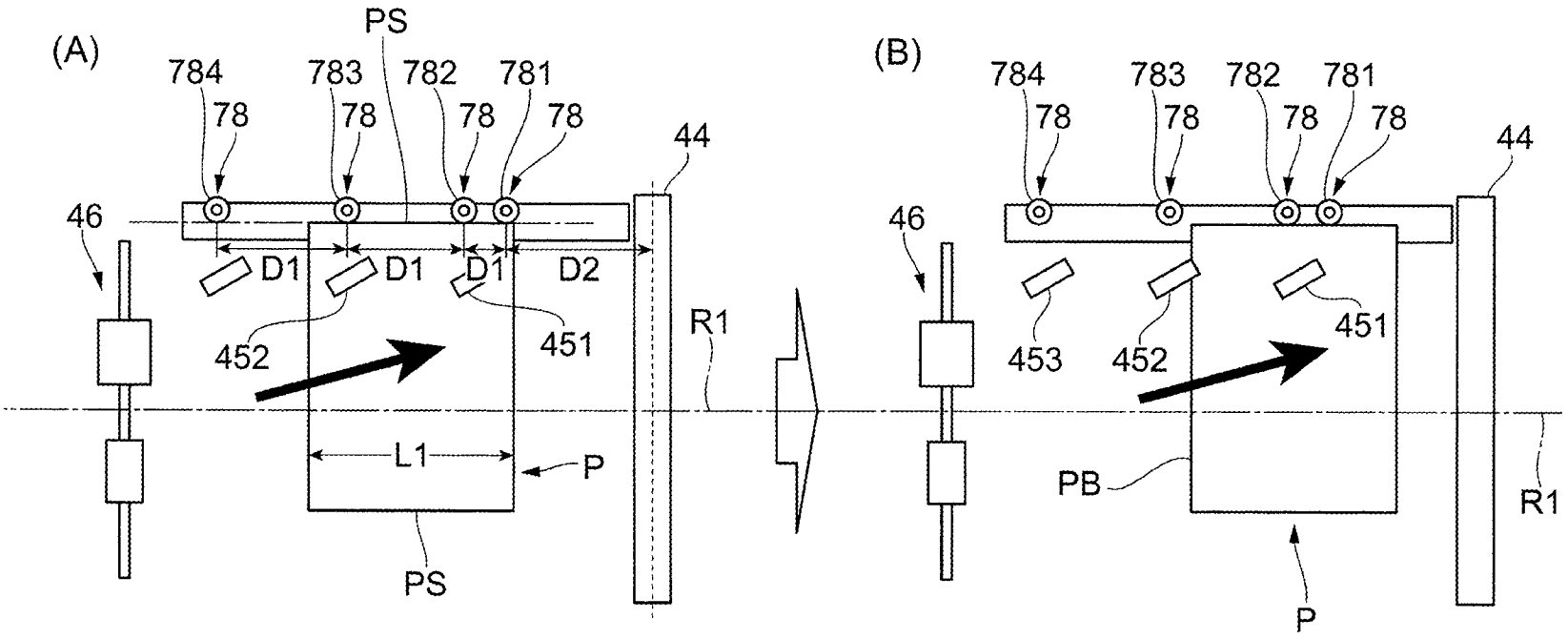
FIG. 6 also illustrates movements of the sheet.

Next, movements of a sheet P will be described with reference to FIGS. 5 and 6. FIGS. 5 and 6 show movements of a sheet P in a case that the sheet P is of a minimum-size type (among sheet types that are prescribed in a product specification and can be conveyed in the image forming apparatus 100) and is conveyed with its longer side as the head.

In the exemplary embodiment, as shown in part (A) of FIG. 5, when the sheet P has been conveyed to the third conveying rolls 46, it starts to rotate. As a result, the head PF of the sheet P is directed toward a side SF of the first sheet conveyance path R1.

Then, as shown in part (B) of FIG. 5, the sheet P reaches the upstream conveying rolls 453 and the intermediate conveying rolls 452 and comes to be conveyed by them. Since the upstream conveying rolls 453 and the intermediate conveying rolls 452 are inclined from the extending direction of the first sheet conveyance path R1, the sheet P is moved toward the butting target members 78 as it is conveyed downstream.

Then, as shown in part (A) of FIG. 6, the sheet P reaches the downstream conveying rolls 451 and comes to be conveyed by the intermediate conveying rolls 452 and the downstream conveying rolls 451. As shown in part (A) of FIG. 6, the side edge PS of the sheet P butts against part of the butting target members 78, more specifically, the first to third butting target members 781-783.

Butting against these butting target members 78, the side edge PS of the sheet P comes to extend parallel with the first sheet conveyance path R1. In other words, a state is established that the sheet P is parallel with the first sheet conveyance path R1 and hence is not inclined. As a result, in the exemplary embodiment, such a problem as an image being formed on a sheet P so as to be inclined with respect to its side edge PS is not likely to occur.

In the exemplary embodiment, since the sheet P is rotated in the above-described manner, its portion on the side of the tail PB (see part (B) of FIG. 5) comes into contact with the butting target members 78 earlier than its portion on the side of the head PF does. As a result, the sheet P is less likely damaged than in a case that its portion on the side of the head PF comes into contact with the butting target members 78 earlier than its portion on the side of the tail PB.

Subsequently, as shown in part (B) of FIG. 6, the tail PB of the sheet P passes the intermediate conveying rolls 452 and the sheet P comes to be conveyed downstream by the downstream conveying rolls 451. Then the sheet P passes the first conveying rolls 44 and goes toward the secondary transfer device 30 (see FIG. 1).

Figure 7:
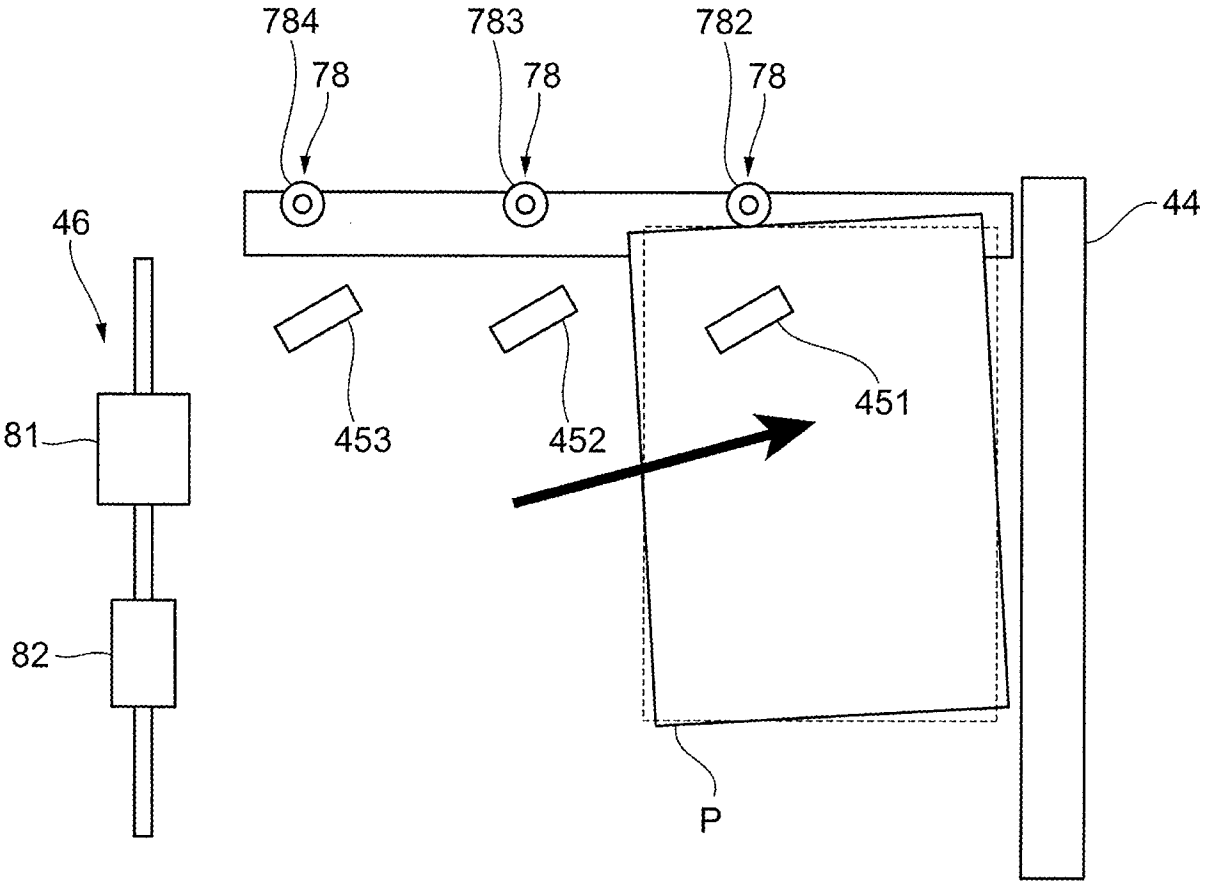
FIG. 7 shows butting target members according to a comparative example.

FIG. 7 shows butting target members 78 according to a comparative example. In the comparative example, unlike in the exemplary embodiment, the first butting target member 781 is not provided, that is, only one butting target member 78 (second butting target member 782) is disposed downstream of the intermediate conveying rolls 452 (located second in the upstream direction).

Since the only one butting target member 78 is disposed downstream of the intermediate conveying rolls 452, a sheet P exhibits unstable behavior and is prone to incline. Also in the comparative example, after passing the intermediate conveying rolls 452, a sheet P is conveyed only by the one pair of downstream conveying rolls 451. In this case, since the sheet P is nipped at a smaller number of positions, the sheet P is more prone to rotate than in a state that it is conveyed by the two pairs of conveying rolls, that is, the intermediate conveying rolls 452 and the downstream conveying rolls 451.

Furthermore, in the comparative example, since the only one butting target member 78 is disposed downstream of the intermediate conveying rolls 452, the sheet P is prone to rotate, that is, incline, about the one butting target member 78 when it hits the one butting target member 78 after passing the intermediate conveying rolls 452.

In contrast, in the exemplary embodiment, after passing the intermediate conveying rolls 452, a sheet P hits two butting target members 78, that is, the first butting target member 781 and the second butting target member 782. Since the sheet P is supported at three positions, that is, supported by the two butting target members 78 and the downstream conveying rolls 451, rotation of the sheet P is suppressed and hence it is not likely to incline.

In the exemplary embodiment, as shown in part (A) of FIG. 6, the installation intervals D1 between the butting target members 78 are shorter than the length L1 of the side edges PS (shorter sides) of a sheet P having the minimum conveyable size.

Furthermore, the interval D2 between the most downstream, first butting target member 781 and (the sheet nipping portion of) the first conveying rolls 44 (an example of another sheet conveying structure) is shorter than the length L1 of the side edges PS of a sheet P having the minimum conveyable size.

With these measures, a sheet P is not prone to enter the spaces between the adjoining butting target members 78 or the space between the first butting target member 781 and the first conveying rolls 44 and hence can be conveyed more stably.

What is more, in the exemplary embodiment, as shown in FIG. 2, the first butting target member 781 is located downstream of the downstream conveying rolls 451 (most downstream sheet conveying structure) and upstream of the first conveying rolls 44.

With this measure, the posture of a sheet P is made more stable when it reaches the first conveying rolls 44 than in a configuration that no butting target member 78 is disposed between the downstream conveying rolls 451 and the first conveying rolls 44. As a result, the sheet P reaches the first conveying rolls 44 with only a very small inclination.

In the comparative example shown in FIG. 7, no butting target member 78 is disposed between the downstream conveying rolls 451 and the first conveying rolls 44. Therefore, a sheet P is prone to incline (assume an improper posture) immediately before reaching the first conveying rolls 44.

In contrast, in the exemplary embodiment in which the one butting target member 78 is disposed between the downstream conveying rolls 451 and the first conveying rolls 44, a sheet P is not prone to incline there and reaches the first conveying rolls 44 in a state that it is closer to being parallel with the first sheet conveyance path R1.

Figure 8:
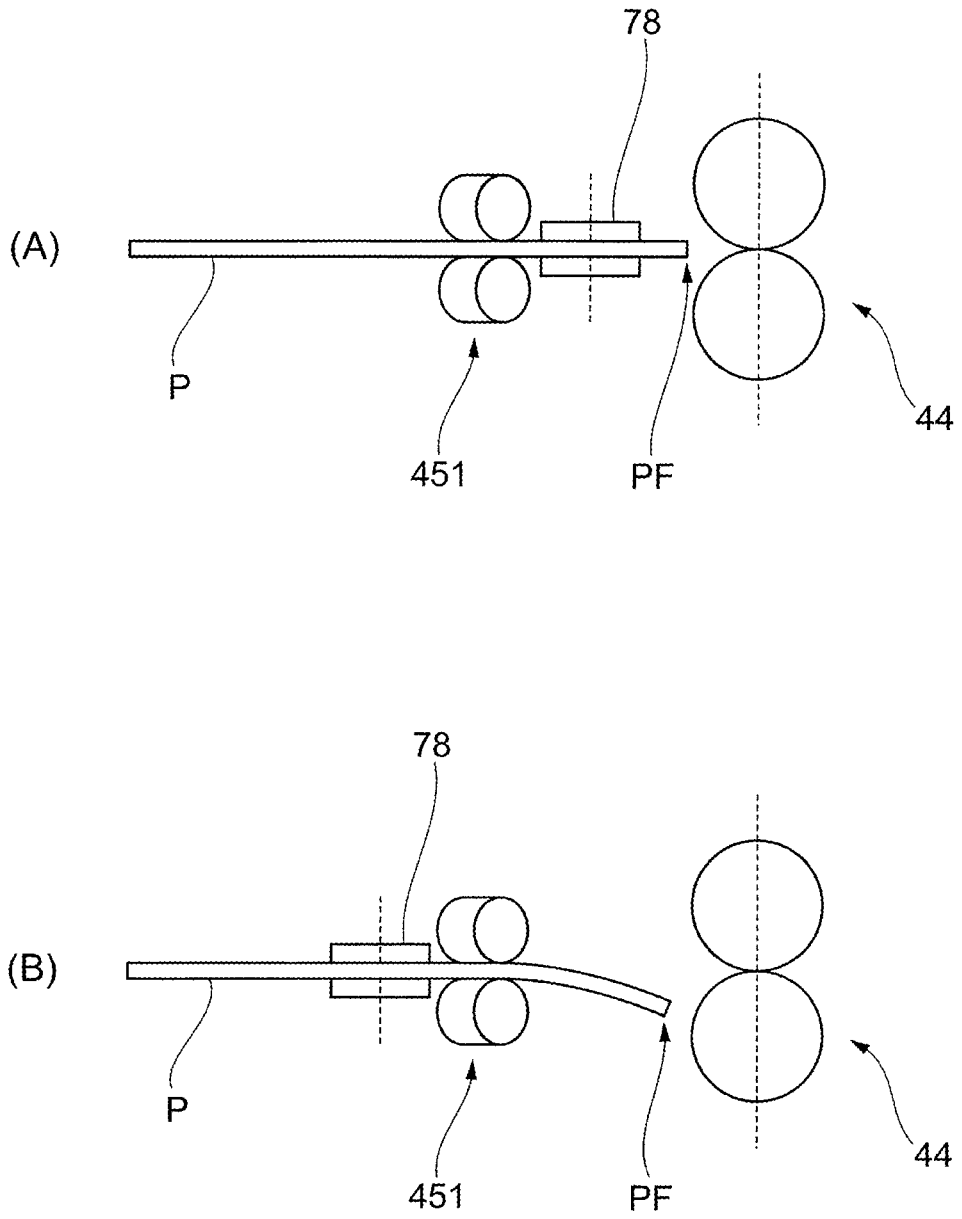
FIG. 8 is views of downstream conveying rolls etc. as viewed from the direction indicated by arrow VIII in FIG. 2.

FIG. 8 is views of the downstream conveying rolls 451 etc. as viewed from the direction indicated by arrow VIII in FIG. 2. Since the one butting target member 78 is disposed between the downstream conveying rolls 451 and the first conveying rolls 44, as shown in part (A) of FIG. 8 the behavior of a sheet P is made stable also in the height direction. The phenomenon is suppressed that a sheet P reaches the first conveying rolls 44 with its head PF lowered.

In the exemplary embodiment, as described above, the first slant surface 780B is provided (see FIG. 4) which lifts up the head PF of a sheet P. Therefore, if the head PF of a sheet P is lowered, it is lifted up by the first slant surface 780B. This suppresses the phenomenon that a sheet P reaches the first conveying rolls 44 with its head PF lowered.

If as shown part (B) in FIG. 8 no butting target member 78 were disposed between the downstream conveying rolls 451 and the first conveying rolls 44, a sheet P would be prone to reach the first conveying rolls 44 with its head PF lowered.

Figure 9:
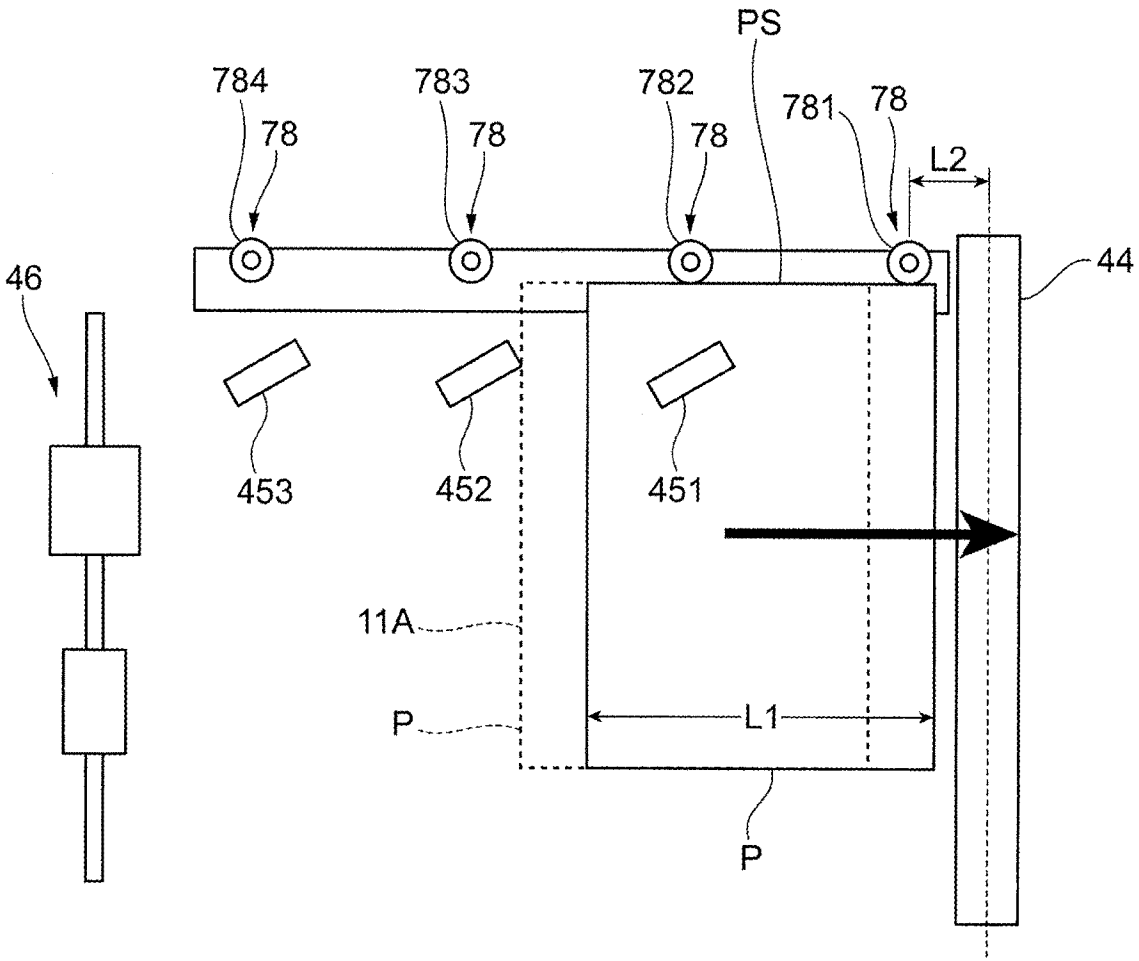
FIG. 9 shows another example configuration.

FIG. 9 shows another example configuration in which the first butting target member 781 is disposed at a position that is downstream of its position in the above-described configuration; that is, the first butting target member 781 is disposed immediately upstream of the first conveying rolls 44.

In this configuration, a sheet P is guided by butting target members 78 until even immediately before entering the first conveying rolls 44, whereby the sheet P enters the first conveying rolls 44 with even a smaller inclination.

Let L1 and L2 represent the length of the shorter sides PS of a sheet P having a minimum conveyable size and the distance between the most downstream, first butting target member 781 and (the sheet nipping portion of) the first conveying rolls 44 (sheet conveying structure), respectively. Then it is preferable to dispose the first butting target member 781 at a position that satisfies a relationship $L2 < (1/3)L1$.

The inventors compared sheet P inclinations of a case that the first butting target member 781 was disposed at positions that satisfy the above relationship and a case that the first butting target member 781 was disposed at positions that do not. And the inventors found that the inclination of a sheet P was smaller in the case that the first butting target member 781 was disposed at a position that satisfies the above relationship than in the case that the first butting target member 781 was disposed at a position that does not.

In the example configuration shown in FIG. 9, a sheet P is rendered into a state that it is in contact with only the second butting target member 782 immediately after passing the intermediate conveying rolls 452 (indicated by symbol 11A in FIG. 9). In view of this, an even preferable example configuration is shown in FIG. 10.

Figure 10:
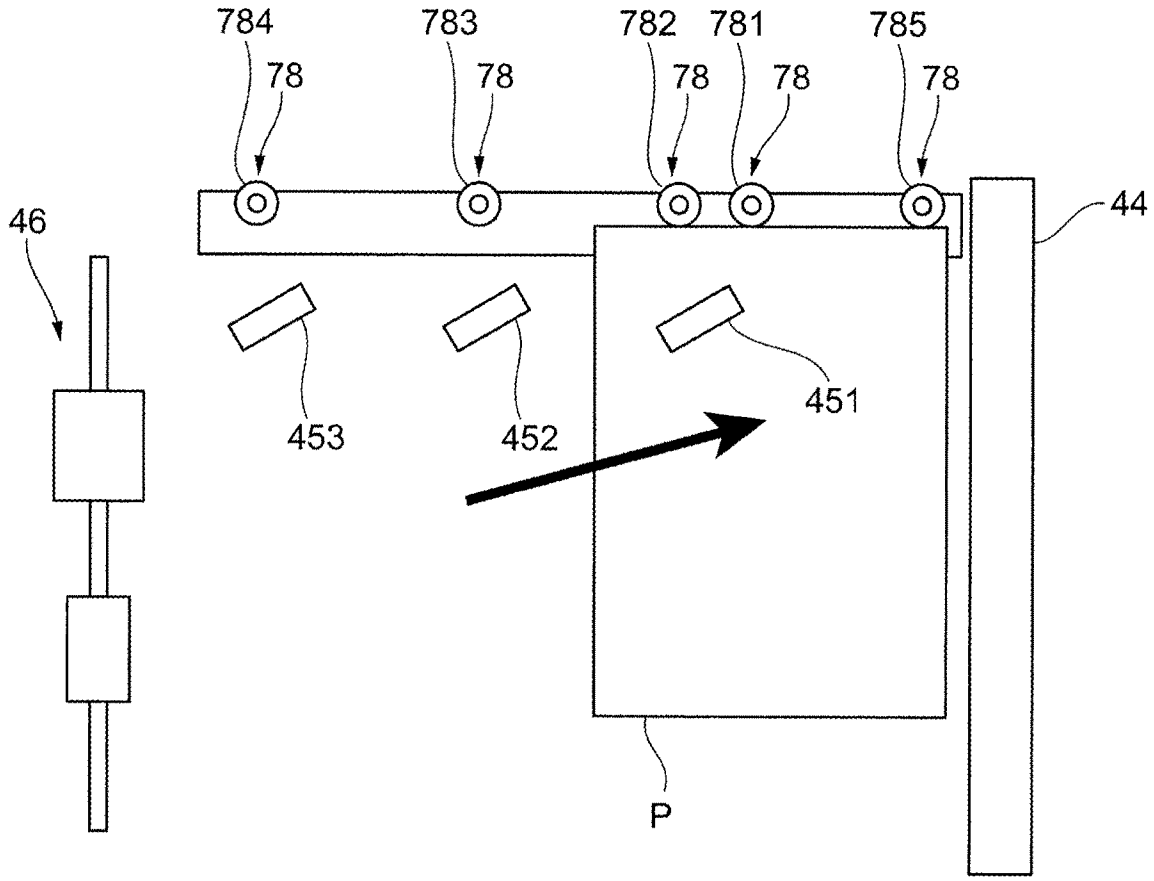
FIG. 10 shows a further example configuration.

In the example configuration shown in FIG. 10, a fifth butting target member 785 is disposed downstream of the first butting target member 781 in addition to the first to fourth butting target members 781-784.

In this example configuration, a sheet P is rendered into a state that it is in contact with the first butting target member 781 and the second butting target member 782 immediately after passing the intermediate conveying rolls 452. Furthermore, the sheet P butts against the fifth butting target member 785 immediately before reaching the first conveying rolls 44.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A sheet conveying device comprising:

a conveyance path along which a sheet is conveyed;

a plurality of butting target members, arranged beside the conveyance path and along a sheet conveying direction, against which a side edge of a sheet being conveyed along the conveyance path is caused to butt; and a butting device that causes the side edge of the sheet to butt against the butting target members by moving, toward the butting target members, the sheet being conveyed along the conveyance path using a plurality of sheet conveying structures that are deviated from each other in a sheet conveying direction, wherein two or more butting target members of the plurality of butting target members are located downstream of a sheet conveying structure of the plurality of sheet conveying structures that is located closest in the upstream direction from a most downstream sheet conveying structure from among the plurality of sheet conveying structures, wherein a single butting target member of the plurality of butting target members corresponds to each sheet conveying structure of the plurality of sheet conveying structures, except for the two or more butting target members, wherein one butting target member of the two or more butting target members corresponds to a sheet conveying structure and additional butting target members of the two or more target members are located downstream of a most downstream sheet conveying structure, and wherein each sheet conveying structure has a width in the conveying direction, and its single corresponding butting target member is located within the width of its respective sheet conveying structure.

2. The sheet conveying device according to claim 1, wherein installation intervals between the butting target members are shorter than the length of side edges of a sheet of a minimum-size type among sheet types that can be conveyed by the sheet conveying device.

3. The sheet conveying device according to claim 1, further comprising a sheet conveying structure that is disposed downstream of the butting target members and conveys the sheet downstream, wherein the distance between a most downstream butting target member among the plurality of butting target members and the sheet conveying structure is shorter than the length of side edges of a sheet of a minimum-size type among sheet types that can be conveyed by the sheet conveying device.

4. The sheet conveying device according to claim 1, further comprising a sheet conveying structure that is disposed downstream of the butting target members and conveys the sheet downstream, wherein one or more of the butting target members are located downstream of the most downstream sheet conveying structure of the butting device and upstream of the sheet conveying structure.

5. The sheet conveying device according to claim 1, wherein each of the butting target members is a rotatable member.

6. The sheet conveying device according to claim 1, wherein each of the butting target members has a slant surface that lifts up a portion, in contact with the butting target member, of the sheet.

7. The sheet conveying device according to claim 1, wherein, at a first position of the sheet, the sheet conveying device is configured to nip the sheet by at least two sheet conveying structures and two butting target members and, at a second position of the sheet, the sheet conveying device is configured to nip the sheet by at least two sheet conveyance devices and two or more butting target members.

* * * * *